US006889835B2

(12) United States Patent
Land

(10) Patent No.: US 6,889,835 B2
(45) Date of Patent: May 10, 2005

(54) PACKAGING FOR CONTAINING AND DISPENSING LARGE QUANTITIES OF WIRE

(75) Inventor: James T. Land, Concord Township, OH (US)

(73) Assignee: Lincoln Global, Inc., Monterey Park, CA (US)

( * ) Notice: Subject to any disclaimer, the term of this patent is extended or adjusted under 35 U.S.C. 154(b) by 0 days.

(21) Appl. No.: 10/681,691

(22) Filed: Oct. 8, 2003

(65) Prior Publication Data

US 2004/0069669 A1 Apr. 15, 2004

Related U.S. Application Data

(62) Division of application No. 09/944,565, filed on Sep. 4, 2001, now Pat. No. 6,648,141.

(51) Int. Cl.[7] ..... B65D 85/67
(52) U.S. Cl. ..... 206/408; 206/409; 242/172
(58) Field of Search ..... 206/397, 398, 206/408, 409; 242/128, 129, 171, 172

(56) References Cited

U.S. PATENT DOCUMENTS

| | | | |
|---|---|---|---|
| 1,640,368 | A | 8/1927 | Obetz et al. |
| 2,724,538 | A | 11/1955 | Schweich |
| 2,838,922 | A | 6/1958 | Gift |
| 2,864,565 | A | 12/1958 | Whearley |
| 2,929,496 | A | 3/1960 | Muehlebach et al. |
| 2,974,850 | A | 3/1961 | Mayer |
| 3,244,347 | A | 4/1966 | Jenk |
| 3,463,416 | A | 8/1969 | Quenot |
| 3,491,876 | A | 1/1970 | Zecchin |
| 3,648,920 | A | 3/1972 | Stump |
| 3,815,842 | A | 6/1974 | Scrogin |
| 4,013,168 | A | 3/1977 | Bamburg et al. |
| 4,160,533 | A | 7/1979 | Kotzur et al. |
| 4,222,535 | A | 9/1980 | Hosbein |
| 4,451,014 | A | 5/1984 | Kitt et al. |

(Continued)

FOREIGN PATENT DOCUMENTS

| | | |
|---|---|---|
| EP | 1057 751 A1 | 12/2000 |
| WO | WO 88/10230 | 12/1988 |
| WO | WO 94/19258 | 9/1994 |

OTHER PUBLICATIONS

Weld Point® Robotic Welding Wire, Technology of the Future—Literature off website www.sidergas.com/uk-prod.htm.

PROSTAR, Premium Quality Twist–Free Robotic Welding Wire—literature.

The Squaring of the Cirlce—literature.

*Primary Examiner*—David T. Fidei
(74) *Attorney, Agent, or Firm*—Fay, Sharpe, Fagan, Minnich & McKee, LLP

(57) ABSTRACT

A package for containing and dispensing wire from a coil of wire having an outer surface, an inner surface, and a top and bottom defining a coil height comprising an outer carton having a rectangular bottom wall and four side panels extending upwardly from the bottom wall. The package further includes an octagonal inner liner having eight walls and wherein every other wall engages a portion of one of the side panels of the outer carton. The package has a planar retainer ring which engages the top of the wire coil and which has an opening forming an inner edge and an outer periphery comprising a plurality of nodes extending radially outwardly beyond the outer surface of the wire coil. Adjacent nodes are connected by a node edge extending inwardly across the outer surface of the coil, and at least one of the nodes interengages with the liner at a corner between adjacent walls thereof to prevent the retainer ring from rotating relative to the inner liner and to prevent the wire from passing the outer peripheral edge of the retainer ring.

21 Claims, 6 Drawing Sheets

U.S. PATENT DOCUMENTS 4,549,673 A 10/1985 Kupersmit
4,582,198 A 4/1986 Ditton
4,591,110 A 5/1986 Wirts et al.
4,623,063 A 11/1986 Balkin
4,724,960 A 2/1988 Goodrum et al.
4,869,367 A 9/1989 Kawasaki et al.
4,974,291 A 12/1990 McNerney
5,078,269 A 1/1992 Dekko et al.
5,105,943 A 4/1992 Lesko et al.
5,109,983 A 5/1992 Malone et al.
5,205,412 A 4/1993 Krieg
5,261,625 A 11/1993 Lanoue
5,277,314 A 1/1994 Cooper et al.
5,328,028 A 7/1994 Hale et al.
5,374,005 A 12/1994 Jenkins et al.
5,494,160 A 2/1996 Gelmetti
5,735,429 A 4/1998 Whitworth
5,746,380 A 5/1998 Chung
5,758,834 A 6/1998 Dragoo et al.
5,806,786 A 9/1998 Abe et al.
5,816,466 A 10/1998 Seufer
5,819,934 A 10/1998 Cooper
6,564,943 B2 5/2003 Barton et al.
6,648,141 B2 * 11/2003 Land ..... 206/408

* cited by examiner

PACKAGING FOR CONTAINING AND DISPENSING LARGE QUANTITIES OF WIRE

CROSS-REFERENCE TO RELATED APPLICATION

This application is a divisional of U.S. application Ser. No. 09/944,565 filed Sep. 4, 2001, now U.S. Pat. No. 6,648,141.

This invention relates to the art of dispensing wire and, more particularly to a package for containing and dispensing large quantities of a continuous wire without tangling.

INCORPORATION BY REFERENCE

The present invention relates to feeding large quantities of a continuous wire from a container to a welding operation wherein the wire must be fed to the welding operation without tangling or interruption. Such containers are known in the art and are generally shown and described in Cooper U.S. Pat. No. 5,277,314; Cooper U.S. Pat. No. 5,819,934; Chung U.S. Pat. No. 5,746,380; Kawasaki U.S. Pat. No. 4,869,367 and Gelmetti U.S. Pat. No. 5,494,160. These patents are incorporated by reference herein as background information illustrating packages for containing and dispensing large quantities of wire. Further, these patents illustrate the importance of controlling the wire as it is being dispensed from the package to prevent tangling.

Seufer U.S. Pat. No. 5,816,466 illustrates the interaction between the wire package and the wire feeder which is a part of the welding apparatus and is incorporated by reference herein as background information.

BACKGROUND OF THE INVENTION

The present invention is particularly applicable for use in connection with welding wire and, therefore, the invention will be described with particular reference to a package containing a large quantity of welding wire stored therein as a coil containing many convolutions formed into layers. However, the invention has broader applications and may be used with any type of wire or other wire-like materials.

It is, of course, well known that welding is an effective method of joining metal components. Further, it is well known that utilizing a welding wire as a consumable electrode in the welding process enhances the weld. Accordingly, it is desirous to package welding wire so that it can be cost effectively utilized. Furthermore, welding applications wherein large quantities of welding wire are consumed necessitate welding wire packages which contain large quantities of a continuous welding wire. Accordingly, large welding wire packages have been created for these applications which allow for a significant amount of welding run time before the operation must be shut down to restring a new package of welding wire. This is particularly important for automated or semi-automated welding operations.

In order to work in connection with the wire feeder of the welder, the welding wire must be dispensed in a non-twisted, non-distorted and non-canted condition which produces a more uniform weld without human attention. It is well known that wire has a tendency to seek a predetermined natural condition which can adversely affect the welding process. Accordingly the wire must be sufficiently controlled by the interaction between the welding wire package and the wire feeder. To help in this respect, the manufacturers of welding wire produce a wire having natural cast wherein if a segment of the wire was laid on the floor, the natural shape of the wire would be essentially a straight line; however, in order to package large quantities of the wire, the wire is coiled into the package which can produce a significant amount of wire distortion and tangling as the wire is dispensed from the package. As a result, it is important to control the payout of the wire from the package in order to reduce twisting, tangling or canting of the welding wire. This condition is worsened with larger welding wire packages which are favored in automated or semi-automated welding.

The payout portion of the welding wire package helps control the outflow of the welding wire from the package without introducing additional distortions in the welding wire to ensure the desired continuous smooth flow of welding wire. Both tangling or breaking of the welding wire can cause significant down time while the damaged wire is removed and the wire is re-fed into the wire feeder. In this respect, when the welding wire is payed out of the welding wire package, it is important that the memory or natural cast of the wire be controlled so that the wire does not tangle. The welding wire package comprises a coil of wire having many layers of wire convolutions laid from the bottom to the top of the package. These convolutions include an inner diameter and an outer diameter wherein the inner diameter is substantially smaller than the width or outer diameter of the welding wire package. The memory or natural cast of the wire causes a constant force in the convolutions of wire which is directed outwardly such that the diameter of the convolutions is under the influence of force to widen. The walls of the wire welding package prevent such widening. However, when the welding wire payes out of the package, the walls of the package loose their influence on the wire and the wire is forced toward its natural cast. This causes the portion of the wire which is being withdrawn from the package to loosen and tend to spring back into the package thereby interfering and possibly becoming tangled with other convolutions of wire. In addition to the natural cast, the wire can have a certain amount of twist which causes the convolutions of welding wire in the coil to spring upwardly.

Retainer rings have been utilized to control the spring back and upward springing of the wire along with controlling the payout of the wire. This is accomplished by positioning the retainer ring on the top of the coil and forcing it downwardly against the natural springing effect of the welding wire. The downward force is either the result of the weight of the retainer ring or a separate force producing member such as an elastic band connected between the retainer ring and the bottom of the package. Further, the optimal downward force during the shipment of the package is different than the optimal downward force for the payout of the welding wire. Accordingly, while elastic bands or other straps are utilized to maintain the position of the retainer ring during shipping, the weight of the retainer ring can be used to maintain the position of the retainer ring relative to the wire coils during payout. With respect to managing the outward flow of wire, or payout, the retainer ring's position on the top of the wire coil holds the upper layers of the convolutions in place as the wire is withdrawn one convolution at a time. In addition, the retainer ring includes an inwardly facing edge which controls the payout of the wire. In this respect, the wire is pulled from the center of the retainer ring and engages the inwardly facing edge. The retainer ring further includes a mechanism to prevent the wire from springing around the outside of the retainer ring. Prior art retainer rings utilize resilient members which tightly engage the inner surface of the package to protect the outer convolutions of the welding wire coil and prevent the wire from springing around the outside of the retainer ring. However, by having frictional engagement between the retainer ring and the inner container walls drag is introduced which adversely reduces the downward force of the retainer ring on the wire coil can and can adversely jam the retainer ring above the wire coil, thereby reducing its control on the wire payout. In order to overcome the retainer ring drag, the weight of the retainer ring must be increased or separate weight must be utilized.

The ability to inexpensively dispose of the welding wire package is also important. While rigid packages can advantageously reduce the tendency of coil shifting within the package during shipment and use, and enhance the stackability of the package, they can be difficult and expensive to dispose of. In welding operations which consume significant quantities of welding wire, stackability and movement characteristics of the full package along with the ability to dispose of the empty package can all play a significant roll in the support operations for the welding process.

SUMMARY OF THE INVENTION

In accordance with the present invention, provided is a welding wire package is provided which includes a retainer ring that interacts with the inner liner of the welding wire package to control the payout of the welding wire and which ring and package are easily disposed of once the welding wire of the package has been consumed. In this respect, a package in accordance with the present invention includes a retainer ring conforming to the inner walls of the package and including portions that extend radially beyond the outer diameter of the wire coil convolutions for minimizing or eliminating the frictional interengagement between the retainer ring and the inner walls of the package. By including portions which extend beyond the outer diameter of the wire coil, the retainer ring advantageously prevents convolutions from springing outside of the ring without necessitating excessive frictional interengagement between the retainer ring and the inner walls of the package.

Preferably, the retainer ring according to the present invention is used in connection with an inner liner having an octagonal cross-sectional configuration, wherein the extending portions of the retainer ring extend beyond the outer diameter of the wire coil into the corners of the octagonal liner. By extending beyond the outer diameter of the wire coil, frictional interengagement with the inner liner is not required and the retainer ring is allowed to freely descend downwardly within the inner liner as the wire is payed out of the package. The lack of frictional engagement allows a lighter and a more disposable retainer ring to be utilized which is inexpensive to manufacture while still being effective in controlling the payout of the welding wire. When used in connection with a disposable cardboard-style box package, the arrangement makes disposal of the packaging after use less costly. This is especially advantageous in high volume welding processes such as for automated or semi-automated welding.

Another aspect of the present invention is that the engagement points between the wire coil and the inner liner are spaced from the engagement points between the retainer ring and the inner liner. Therefore, the forces produced by the convolutions of the coiled wire are controlled by the inner liner and are spaced from the extensions of the retainer ring which further prevents the convolution from passing outside the ring. In this respect, whether an octagonal liner is used, or merely a square box, or even a cylindrical container with supports, the outer diameter of the welding wire interengages with the inner surfaces of the welding wire package at predetermined points equally spaced within the welding wire package. With respect to octagonal inner liners, the outer diameters of the convolutions interengage the vertically extending planar walls of the inner liner generally at their centers. Conversely, the retainer ring extensions engage the inner liner at one or more of the corners between the vertically extending walls. As a result, even though the wire can cause deformation of the central portions of the vertically extending inner liner wall, the extensions on the retainer ring are spaced therefrom and are not affected. Therefore, the retainer ring according to the present invention does not have to interengage with the inner liner to such a degree to account for the potential deformation caused thereto by the wire coil which further reduces the friction therebetween. In addition, by including an inwardly extending edge portion between the extensions, friction is further reduced and the position of the retainer ring is not influenced by the deformation of the liner caused by the outward force produced by the wire coil.

With reference to a square or a circular liner arrangement, the same result can be achieved. In this respect, the retainer ring for a square inner liner configuration, includes extensions which extend into the four corners of the square liner, thereby extending beyond the outer diameter of the wire coil. A cylindrical inner liner or package which includes a plurality of vertically extending support members to retain the outer convolutions of the wire coil utilizes a retainer ring which extends beyond the support members and thus the outer surface of the wire coil.

The primary object of the present invention is the provision of a retainer ring for a wire coil package which allows the continuous and uninterrupted payout of a welding wire from the package smoothly and without tangling.

Another object is the provision of a welding wire package of the foregoing character that can be easily transported and otherwise manipulated into an operating position.

Still another object is the provision of a retainer ring for a welding wire package of the foregoing character which is lightweight and disposable and which provides continuous and smooth payout of the welding wire.

A further object is the provision of welding wire packaging of the foregoing character wherein more components can be easily and inexpensively disposed of after use.

Yet a further object is the provision of a welding wire package of the foregoing character that utilizes a retainer ring which extends radially beyond the outer diameter of a wire coil to prevent the convolutions of the wire coil from escaping beyond the outer edge of the retainer ring without the need of frictional interengagement with the inner surface of the welding wire package.

Another object is the provision of a welding wire package of the foregoing character which utilizes components that are economical to manufacture, easy to use in the field and protect the welding wire.

BRIEF DESCRIPTION OF THE DRAWINGS

The foregoing objects, and others, will in part the obvious and in part be pointed out more fully hereinafter in conjunction with a written description of preferred embodiments of the present invention illustrated in the accompanying drawings in which.

DESCRIPTION OF PREFERRED EMBODIMENTS

Figure 1:
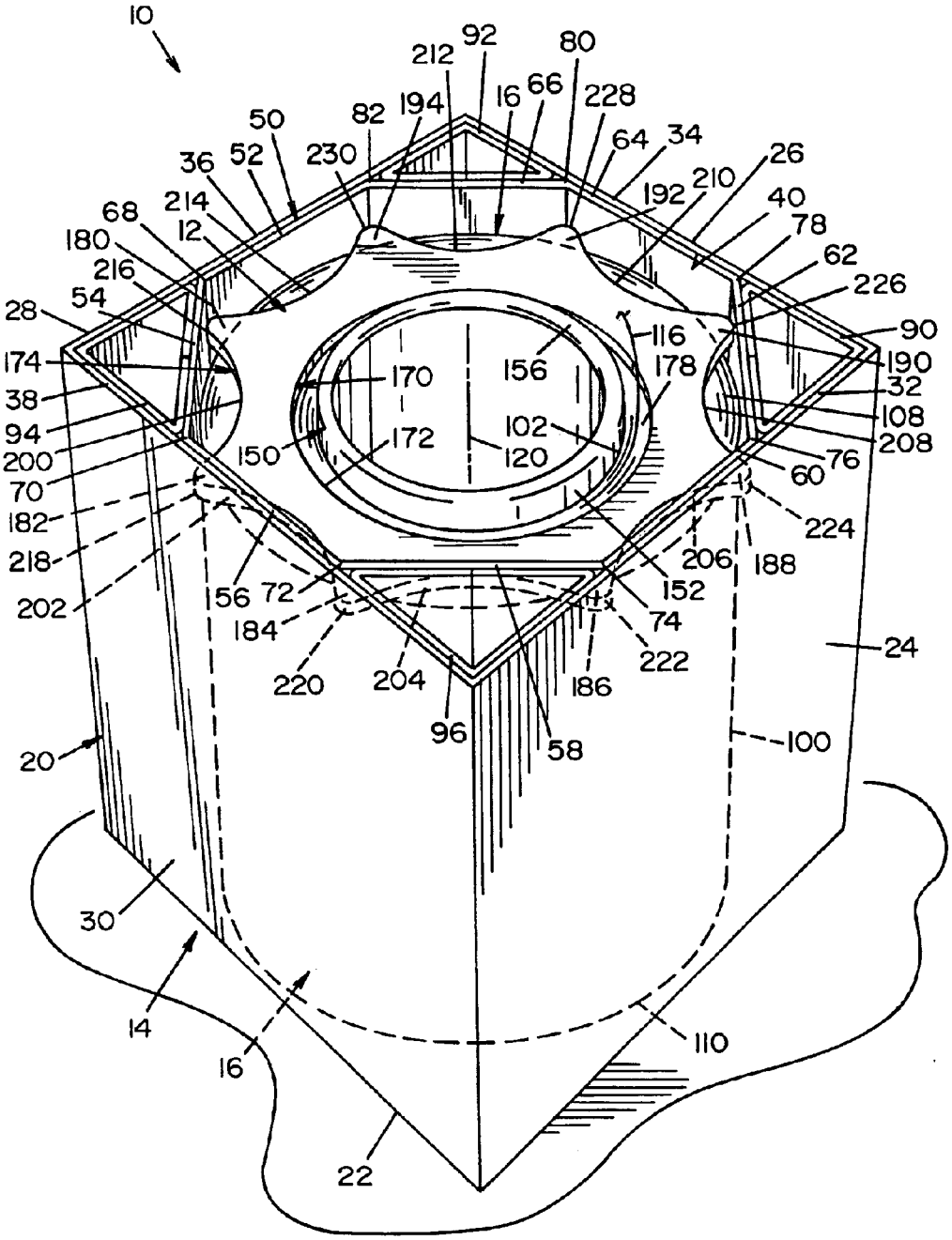
FIG. 1 is a perspective view of the welding wire package including a retainer ring and a continuous strand of welding wire in accordance with the present invention.

Referring now in greater detail to the drawings wherein the showings are for the purpose of illustrating preferred embodiments of the invention only, and not for the purpose of limiting the invention, FIGS. 1, 2, 3, and 4 show a welding wire package 10 which includes a retainer ring 12 and a package portion 14. Package portion 14 is a box product made from cardboard or the like and is shaped to receive a coil of wire 16 in a coil receiving recess 18. Package portion 14 has an outer carton 20 with a square bottom wall 22 and four side panels 24, 26, 28, and 30 which extend vertically from bottom wall 22 an equal distance. Each side panel has a top edge 32, 34, 36, and 38 respectively, forming a square top opening 40. While not shown, it should be noted that any known method can be used to cover or seal top opening 40 for shipping. This can include cardboard flaps which extend from top edges 32, 34, 36, and 38 or a separate top panel which can be secured to the outer carton 20.

Within outer carton 20 is an inner liner 50 extending from bottom 22 to top edges 32, 34, 36, and 38 and having an octagonal cross-sectional configuration formed by eight vertically extending planar walls 52, 54, 56, 58, 60, 62, 64, and 66 which are joined to one another at liner corners 68,70, 72, 74, 76, 78, 80, and 82. The inner surfaces of liner walls 52, 54, 56, 58, 60, 62, 64, and 66 form a portion of the coil receiving recess 18 and the width of the liner between opposed pairs of the walls is equivalent to the outer diameter 84 of wire coil 16. In this respect, liner walls 52, 54, 56, 58, 60, 62, 64, and 66 support the wire coil 16 and prevent the same from expanding with respect to outer diameter 84. Liner walls 52, 54, 56, 58, 60, 62, 64, and 66 are supported by the side panels of outer carton 20 and by triangular corner supports 90, 92, 94, and 96 which also extend essentially from bottom wall 22 to top edges 32, 34, 36, and 38. More particularly, the outer surfaces of liner walls 52, 56, 60, and 64 are supported by side panels 28, 30, 24, and 26, respectively, while the outer surfaces of liner walls 54, 58, 62, and 66 are supported by corner supports 94, 96, 90, and 92, respectively. As with outer carton 20, inner liner 50 and the corner supports 90, 92, 94, and 96 are preferably made from cardboard or other similar materials.

Wire coil 16 is donut shaped having an outer surface 100 and an inner surface 102 with a height 104 which is less than the height 106 of package portion 14. Further, wire coil 16 includes a top and a bottom 108 and 110, respectively, and coil bottom 110 rests on outer carton bottom wall 22 and coil top 108 is below top edges 32, 34, 36, and 38. Wire coil 16 is made of many convolutions of a continuous wire 112 beginning at a first end 114, in proximity of bottom wall 22, and spiraling upwardly in coil receiving recess 18 to second end 116. Second end 116 can be secured to coil top 108 by tape 118 or other suitable fastening devices. Due to the natural cast of the wire, wire coil 16 produces forces radially outwardly from vertically extending axis 120. As stated above, the "natural cast" is the natural shape or curvature of the wire resulting from the internal stresses within the wire created during the manufacture of the wire or by mechanically deforming the wire. The forces are contained by liner walls 52, 54, 56, 58, 60, 62, 64, and 66 of package portion 14. In this respect, outer surface 100 of wire coil 16 engages and is supported by the liner walls 52, 54, 56, 58, 60, 62, 64, and 66 essentially at their centers. By engaging liner walls 52, 54, 56, 58, 60, 62, 64, and 66 at their centers, gaps 122, 124, 126, 128, 130, 132, 134, and 136 are formed adjacent to liner corners 68, 70, 72, 74, 76, 78, 80, and 82.

Package portion 14 further includes an inner sleeve 150 defining the inward boundary of coil receiving recess 18. Inner sleeve 150 is cylindrical and has an outer surface 152, a bottom edge 154 engaging bottom wall 22 and a top edge 156 spaced below the top edges 32, 34, 36, and 38 of side panels 24, 26, 28, and 30. The outer surface 152 is co-axial with axis 120 and has a diameter 158. Bottom edge 154 should be essentially flat to reduce the tendency of the wire adjacent bottom wall 22 to move under the inner sleeve. Top edge 156 can be either a rounded or a flat edge. In order to minimize the weight of the packaging, it is preferred that the inner sleeve 150 be hollow and constructed from a rigid material so as to have enough strength to support wire coil 16 in that inner surface 102 of wire coil 16 rests against outer surface 152 of inner sleeve 150.

Retainer ring 12 is a substantially planar body with an inner opening 170 providing an inner edge 172, and having an outer peripheral edge 174. Inner opening 170 has a diameter 176 which is greater than the diameter 158 of inner sleeve 150 whereby a payout gap 178 is provided therebetween for allowing wire 112 to pass the ring during payout. Outer peripheral edge 174 includes eight extensions or nodes 180, 182, 184, 186, 188, 190, 192, and 194 which are essentially equally spaced thereabout. Adjacent extensions 180, 182, 184, 186, 188, 190, 192, and 194 are joined by radially inwardly extending curvilinear node edges 200, 202, 204, 206, 208, 210, 212, and 214. While edges 200, 202, 204, 206, 208, 210, 212, and 214 are shown as being arcuate, other configurations can be utilized a few of which will be discussed hereinafter. Nodes 180, 182, 184, 186, 188, 190, 192, and 194 include outer extension edges 216, 218, 220, 222, 224, 226, 228, and 230, respectively, which are preferably rounded. When retainer ring 12 is in its operating position within coil receiving recess 18, its bottom surface 232 is juxtaposed coil top 108, and inner opening 170 is substantially co-axial with axis 120. In addition, nodes 180, 182, 184, 186, 188, 190, 192, and 194 extend outwardly from axis 120 beyond outer surface 100 of wire coil 16 and into liner corners 68, 70, 72, 74, 76, 78, 80, and 82, respectively. At least one of outer extension edges 216, 218, 220, 222, 224, 226, 228, and 230 interengages inner liner 50 at the corresponding liner corner which prevents rotation and promotes alignment of retaining ring 12 relative to inner liner 50 and coil 16. Inwardly curved edges 200, 202, 204, 206, 208, 210, 212, and 214 extend inwardlytoward axis 120 and extend radially within outer surface 100. This configuration further reduces the frictional engagement between outer peripheral edge 174 and inner liner 50 by reducing the contact between ring 12 and liner 50, and by spacing outer edge 174 from the point of engagement between outer surface 100 of coil 16 and liner 50. As stated above, the coil 16 and/or the liner 50 can be deformed by outward forces in the coil acting against the liner 50 which can affect the movement and alignment of ring 12. Further, by having the nodes 180, 182, 184, 186, 188, 190, 192, and 194 which extend beyond the outer surface 100 of wire coil 16, the convolutions of wire 112 are not likely to pass about the outside of retainer ring 12 even though there is little frictional interengagement between retainer ring 12 and inner liner 50. These configurations allow a lightweight and easily disposable retainer ring to be used which performs similarly to the more expensive and heavier retainer rings heretofore used. In fact, by including nodes which extend beyond the outer surface 100 of the wire coil, the likelihood of the convolution of wire coil 16 escaping outside of retainer ring 12 is reduced compared to prior art retainer rings.

In the following discussions concerning other embodiments, the components of the welding wire package 10 which remain the same, as discussed above, will include the same reference numbers as above.

Figure 2:
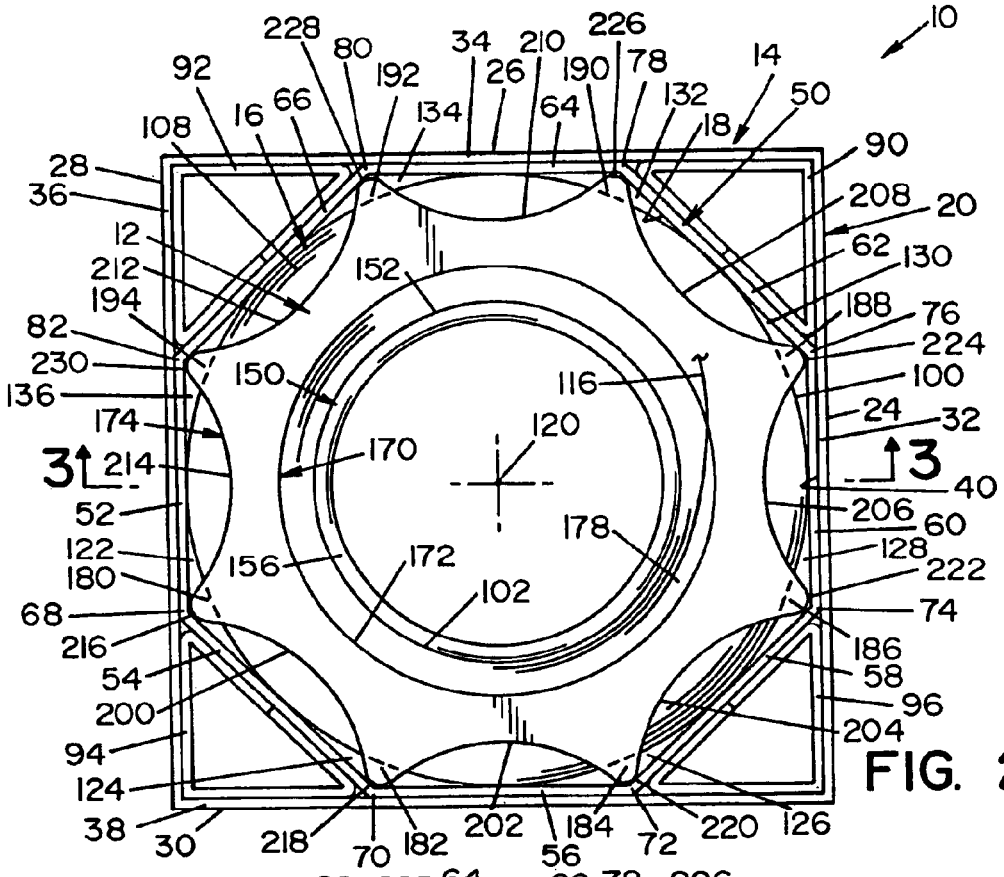
FIG. 2 is a top view of the welding wire package shown in FIG. 1.
Figure 2A:
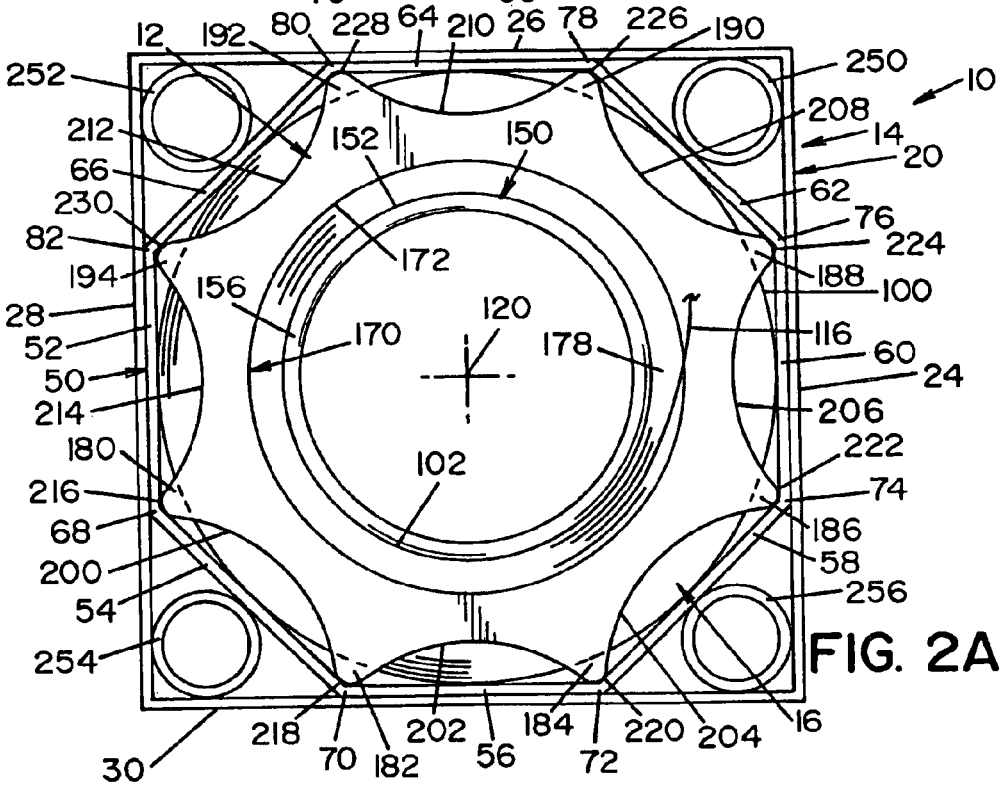
FIG. 2A is a top view of the welding wire package shown in FIG. 1 with a different style corner brace.
Figure 3:
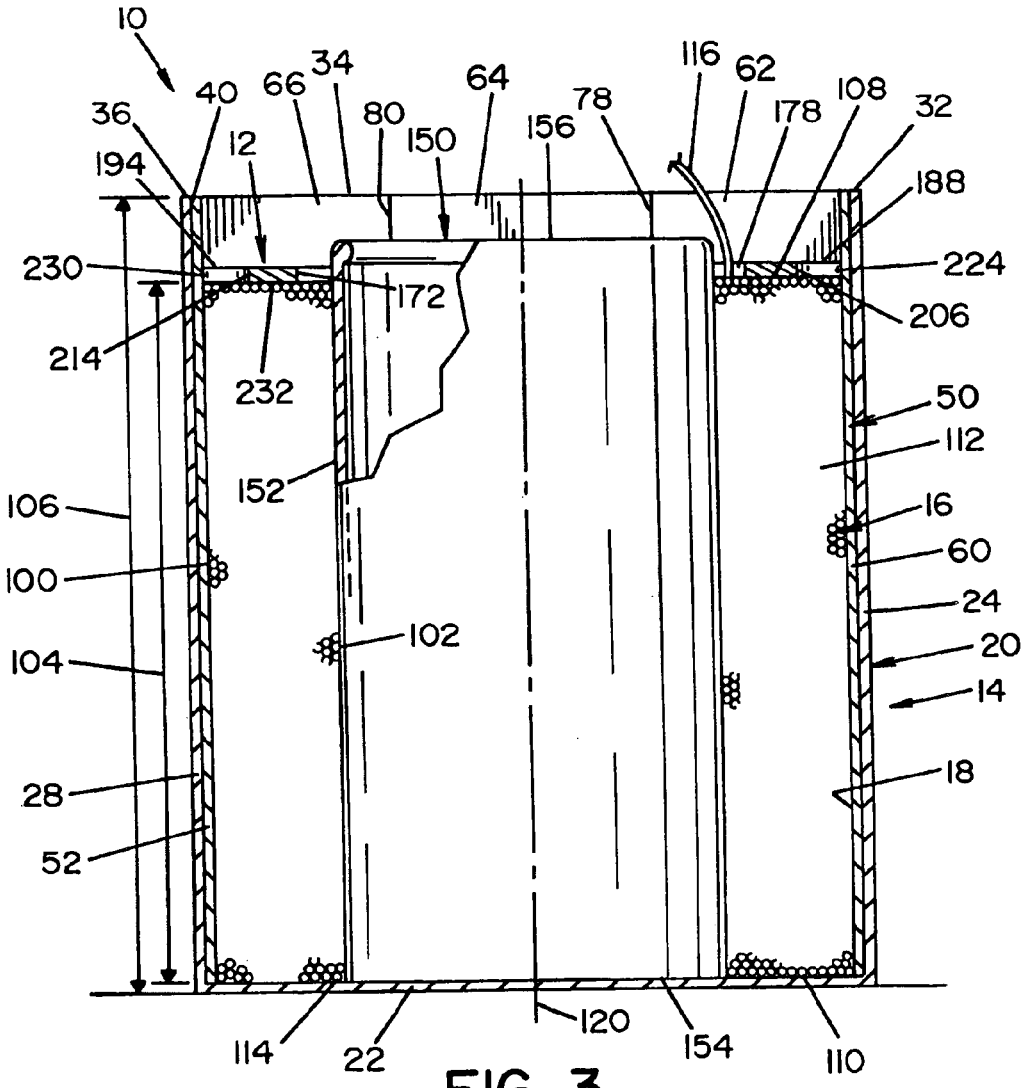
FIG. 3 is a sectional view taken along line 3—3 in FIG. 2.
Figure 4:
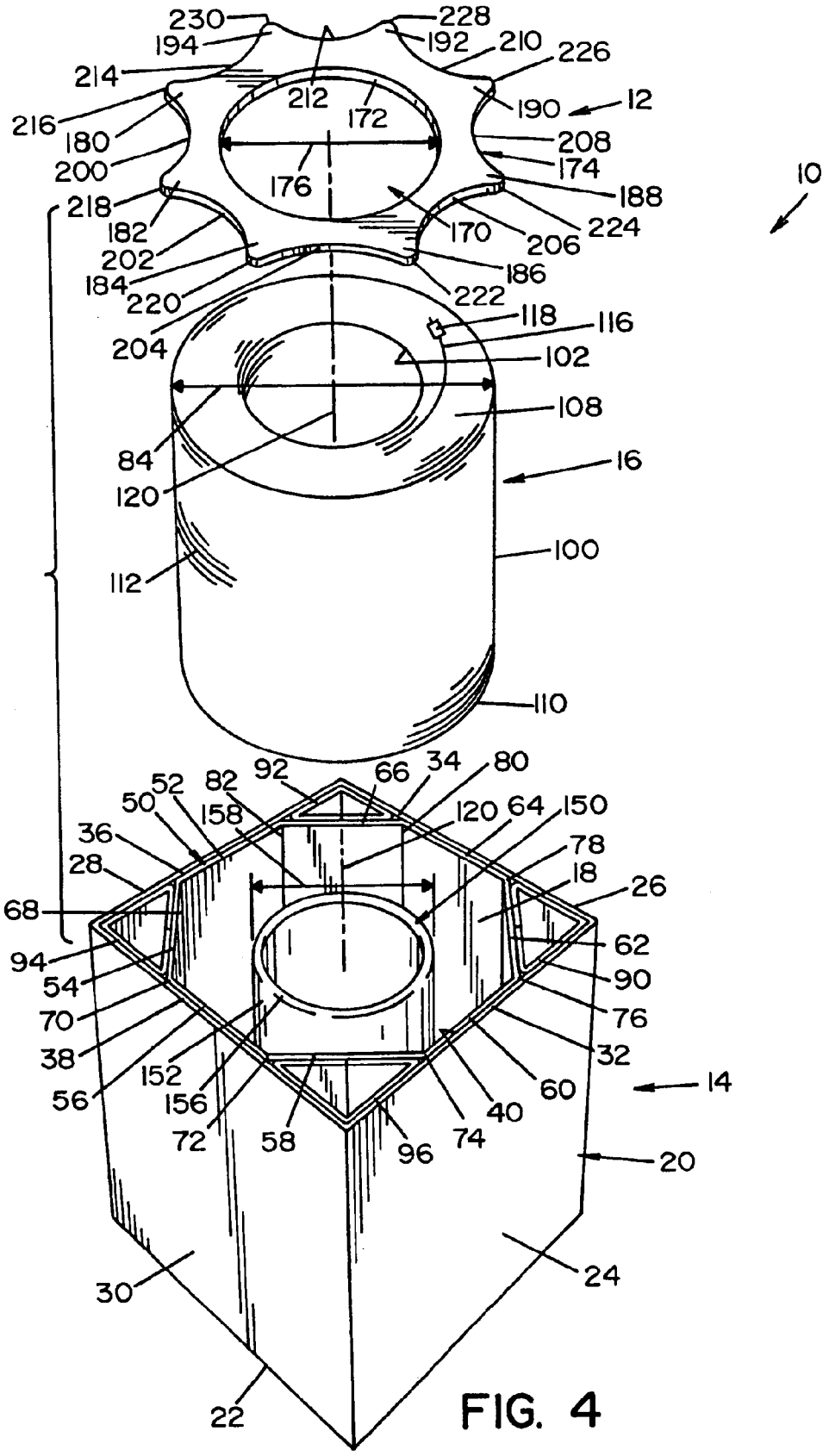
FIG. 4 is a partially exploded perspective view of the components of the welding wire package shown in FIG. 1.

Referring to FIG. 2A, another embodiment of the present invention is shown. While package portion 14 is essentially the same, corner supports 250, 252, 254, and 256 are tubular posts with a circular instead of a triangular cross-sectional configuration.

Figure 5:
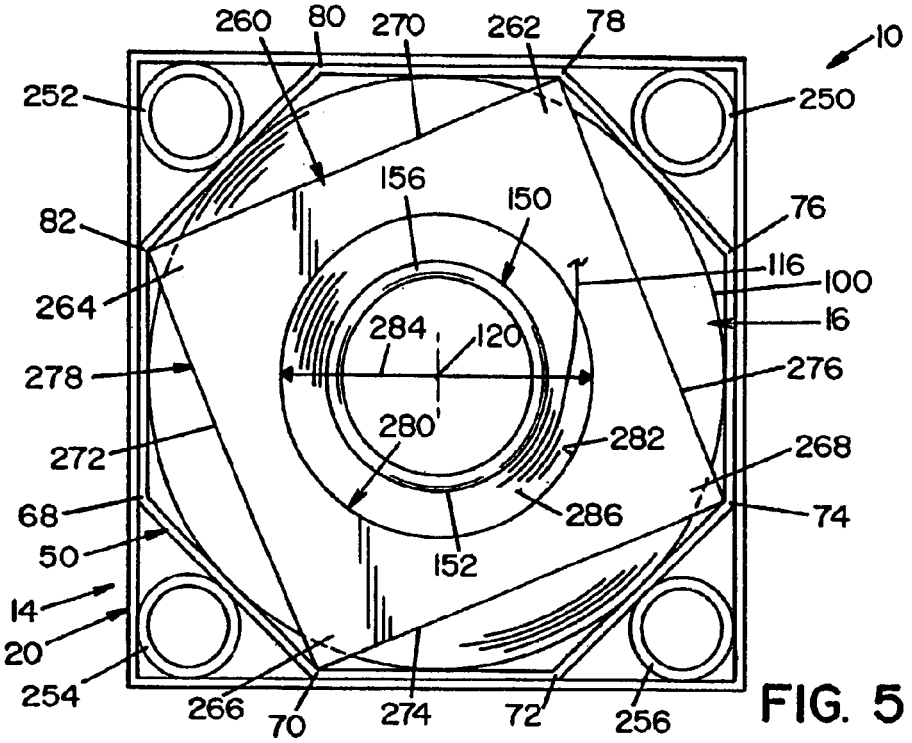
FIG. 5 is a top view of another embodiment of a welding wire package in accordance with the present invention.

Referring to FIG. 5, a retainer ring 260 is shown having four nodes 262, 264, 266, and 268 which are interengaged by straight node edges 270, 272, 274, and 276. In essence, retainer ring 260 has a square outer peripheral edge 278. In similar fashion to retainer ring 12, retainer ring 260 includes an inner opening 280 producing an inner edge 282 with an inner diameter 284 similar to inner diameter 176 of ring 12 and which forms the payout gap 286 with inner sleeve 150. Nodes 262, 264, 266, and 268 extend beyond the outer surface 100 of wire coil 16 thereby preventing the convolutions of wire on coil 16 from extending upwardly past the outer peripheral edge 278 of retainer ring 260. Further, nodes 262, 264, 266, and 268 extend into diametrically opposite liner corners such as corners 78, 82, 70, and 74 in FIG. 5, so that at least one node engages a corner of liner 50 to center and prevent retainer ring 260 from rotating relative to package 14 while minimizing frictional interengagement with the liner.

Figure 6:
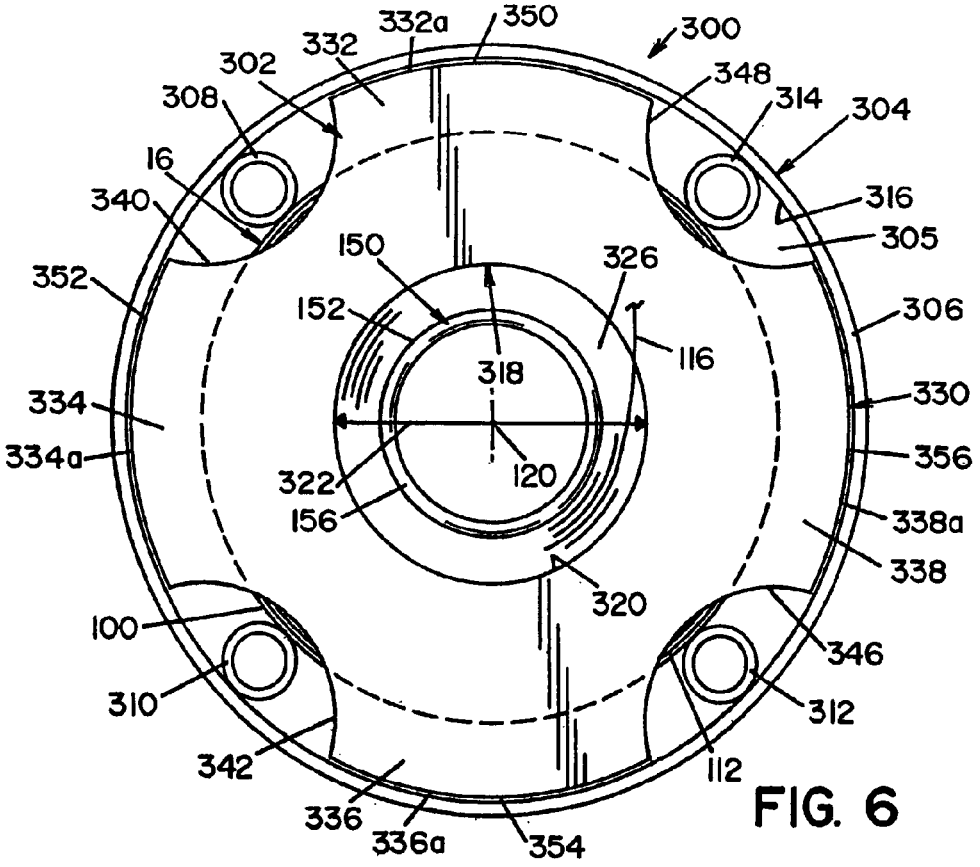
FIG. 6 is a top view of yet another embodiment of a welding wire package in accordance with the present invention.

Referring to FIG. 6, yet another embodiment of packaging is shown. More particularly, shown is a welding wire package 300 having a retainer ring 302 and an outer carton 304. Carton 304 includes a circular bottom wall 305 and a cylindrical side wall panel 306 extending upwardly therefrom a distance greater than the height of coil 16. Welding wire package 300 further includes an inner sleeve 150 which is of the same configuration as previously discussed with respect to the earlier embodiments. Package 300 further includes four cylindrical supports or posts 308, 310, 312, and 314 equally spaced apart about the inner side 316 of wall 306 and secured thereto such as by an adhesive bond. Supports 308, 310, 312, and 314 extend between bottom wall 305 and the upper end of side wall 306 such that outer surface 100 of wire coil 16 is spaced from inner surface 316 of the outer carton. Retainer ring 302 has an inner opening 318 producing an inner edge 320 such that the diameter 322 of the inner opening is greater than the outer diameter 158 of inner sleeve 150. In similar fashion as discussed above, this produces a payout gap 326 for wire 112 to pass through. Retainer ring 302 further includes an outer peripheral edge 330 which includes four nodes 332, 334, 336, and 338 having radially outer edges 332*a*, 334*a*, 336*a*, and 338*a*, respectively, which are arcuate, concave relative to opening 318 and parallel to inner side 316 of wall 306. Adjacent ones of the nodes are joined by inwardly curved node edges 340, 342, 346, and 348 which respectively straddle cylindrical supports 308, 310, 312, and 314. Nodes 332, 334, 336, and 338 extend toward inner surface 316 of outer carton 304, but edges 332*a*, 334*a*, 336*a*, and 338*a* remain spaced therefrom forming gaps 350, 352, 354, and 356 therebetween. As a result, the frictional engagement between retainer ring 302 and inner surface 316 of package 300 is minimized and retainer ring 302 is able to freely move downwardly as wire 112 is removed. The convolutions of welding wire are prevented from moving outside of the outer peripheral edge 330 of retainer ring 302 since the nodes 332, 334, 336, and 338 extend radially outwardly beyond outer surface 100 of wire coil 16. Retainer ring 302 is prevented from rotating relative to outer carton 304 by the engagement between at least one of the inwardly curved edges 340, 342, 346, and 348 and the corresponding cylindrical support 308, 310, 312, and 314.

Figure 7:
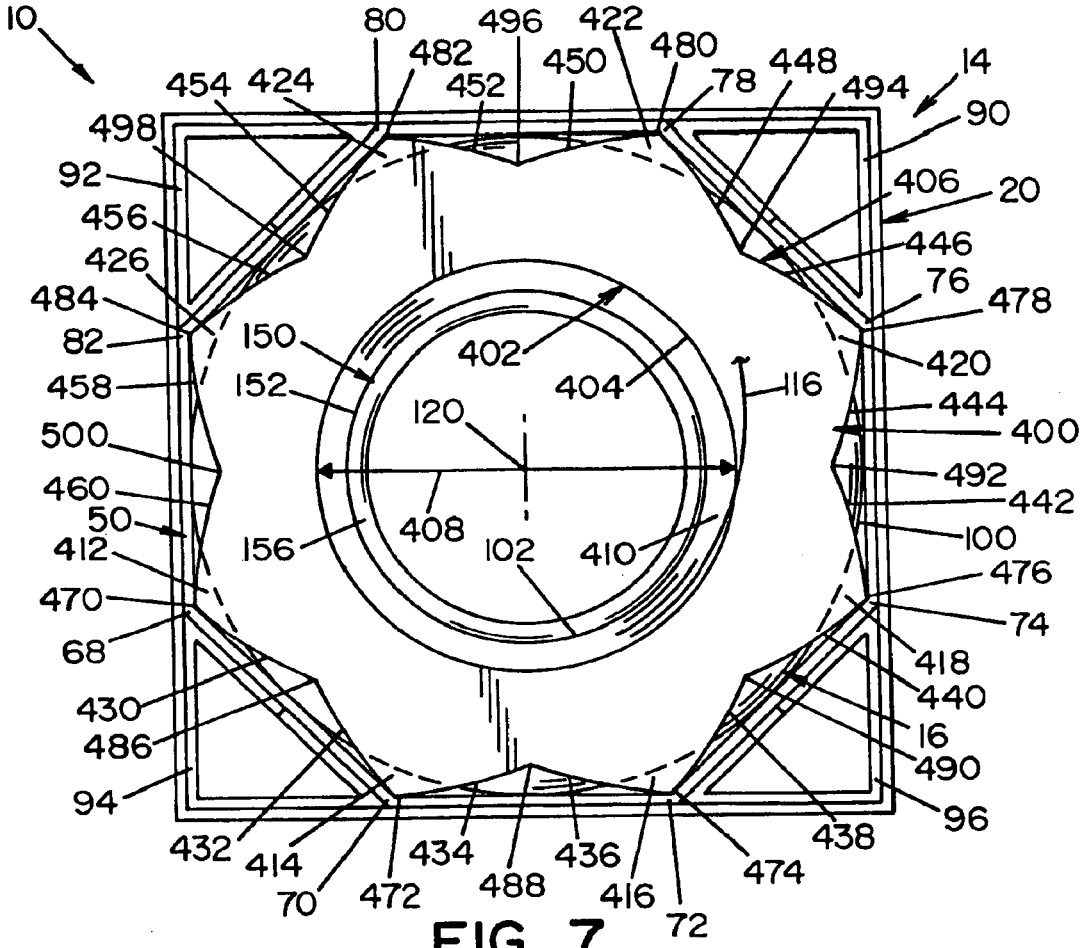
FIG. 7 is a top view of even yet another embodiment of a welding wire package in accordance with the present invention.

Referring to FIG. 7, a retainer ring 400 is shown having an inner opening 402 producing an inner edge 404, and having an outer peripheral edge 406. Inner opening 402 has a diameter 408 which is greater than the diameter 158 of inner sleeve 150 thereby producing a payout gap 410 therebetween. Outer peripheral edge 406 includes eight nodes 412, 414, 416, 418, 420, 422, 424, and 426 which are essentially equally spaced thereabout. Adjacent nodes 412, 414, 416, 418, 420, 422, 424, and 426 are joined by two curvilinear node edges 430, 432, 434, 436, 438, 440, 442, 444, 446, 448, 450, 452, 454, 456, 458, and 460. For example, nodes 412 and 414 are joined by curvilinear edges 430 and 432 which are essentially mirror images of one another. The Nodes 412, 414, 416, 418, 420, 422, 424, and 426 include outer extension edges 470, 472, 474, 476, 478, 480, 482, and 484, respectively. The dual curvilinear edge configuration of this embodiment allows for a better fit between nodes 412, 414, 416, 418, 420, 422, 424, and 426 and liner corners 68, 70, 72, 74, 76, 78, 80, and 82 without increased friction. As with the previously discussed embodiments, at least one of outer extension edges 470, 472, 474, 476, 478, 480, 482, and 484 interengages with inner liner 50 at the corresponding liner corner to prevent rotation of retainer ring 400 relative to inner liner 50 and to maintain the alignment of retainer ring 12 with the wire coil. Further, inward edges 430, 432, 434, 436, 438, 440, 442, 444, 446, 448, 450, 452, 454, 456, 458, and 460 extend inwardly toward axis 120 and intersect at inner edges 486, 488, 490, 492, 494, 496, 498, and 500 which are spaced inwardly outer coil surface 100. This configuration of ring 400 reduces the frictional engagement with inner liner 50 and spaces ring 400 from the engagement point between coil 16 and liner 50. As stated above, this further reduces friction and improves alignment.

While considerable emphasis has been placed on the preferred embodiments of the invention illustrated and described herein, it will be appreciated that other embodiments can be made and that many changes can be made in the preferred embodiments without departing from the principals of the invention. Accordingly, it is to be distinctly understood that the foregoing descriptive matter is to be interpreted merely as illustrative of the invention and not as a limitation.

Having thus described the invention, it is claimed:

1. A package for containing and dispensing wire from a coil of wire, the wire coil having an axis, a radially outer surface about the axis providing an outer coil diameter, and axially opposite top and bottom ends defining a coil height, said package comprising an outer carton having a bottom and four planar side panels extending upwardly from said bottom a distance greater than said height, each said side panel having an inwardly facing side surface; an octagonal inner liner within said outer carton, said liner having eight vertically extending planar walls wherein every other one of said eight walls engages a portion of the inwardly facing side surface of a different one of said side panels of said outer carton, adjacent ones of said eight walls being joined at a liner corner; and a retainer ring engaging the top end of the wire coil, said retainer ring having a substantially planar body including an inner opening and an outer edge comprising a plurality of nodes extending radially outward beyond the outer surface of the wire coil, each of said nodes being joined to an adjacent node by a node edge extending inwardly of the outer surface of the coil, at least one of said nodes interengaging at least one of said liner corners to prevent said retainer ring from rotating relative to said inner liner.

2. The package according to claim 1, wherein said nodes have arcuate, radially outer end edges which are concave with respect to said opening.

3. The package according to claim 2, wherein said node edge is convex with respect to said opening.

4. The package according to claim 3, wherein said coil of wire has a radially inner surface, the package further including an inner sleeve supporting the inner surface of the coil, said inner sleeve having an outside diameter and said opening of said retainer ring having a diameter greater than said outside diameter.

5. The package according to claim 1, wherein said nodes have radially outer edges intersecting one another at an angle.

6. The package according to claim 5, wherein said node edge is linear.

7. The package according to claim 6, wherein said coil of wire has a radially inner surface, the package further including an inner sleeve supporting the inner surface of the coil, said inner sleeve having an outside diameter and said opening of said retainer ring having a diameter greater than said outside diameter.

8. The package according to claim 5, wherein said radially outer edges are arcuate.

9. The retainer according to claim 8, wherein said node edge includes two inwardly curved edges which intersect at a common central point between adjacent nodes.

10. The retainer according to claim 9, wherein said plurality of nodes is eight equally spaced nodes.

11. A container for storing and dispensing a continuous wire from a coil of wire, the wire coil being donut-shaped and having an outwardly facing surface having an outer coil diameter, an inwardly facing surface having an inner coil diameter and top and bottom surfaces defining a coil height, said container comprising an outer carton having a rectangular bottom and side walls extending upwardly from said bottom, each said side wall having inwardly and outwardly facing surfaces; an inner liner including eight upwardly extending liner walls each having inwardly and outwardly facing surfaces, said inner liner having an octagonal cross-sectional configuration, every other one of said outwardly facing surfaces of said liner walls engaging a different one of said inwardly facing surfaces of said sides walls, said inwardly facing surfaces of said liner walls engaging the outwardly facing surface of the wire coil; and a substantially planar retainer ring having an opening producing an inner edge and having an outer peripheral edge, said peripheral edge including eight equally spaced nodes which extend radially outwardly beyond the outer surface of the wire coil, each of said nodes being joined to an adjacent node by at least one inwardly extending curvilinear node edge producing a gap between said peripheral edge and said inner liner, said retainer ring being positioned on the top surface of the wire coil, and said nodes engaging at least one of said liner walls to maintain said retainer ring substantially centered within said side walls of said outer carton and to prevent said retainer ring from rotating relative to said inner liner.

12. The container according to claim 10, wherein said at least one node edge extends inwardly of the outer surface of the wire coil.

13. The container according to claim 12, further including an inner sleeve supporting the inner surface of the coil, said inner sleeve having an outside diameter and said opening of said retainer ring being circular and having a diameter greater than said outside diameter.

14. The container according to claim 10, further including an inner sleeve supporting the inner surface of the coil, said inner sleeve having an outside diameter and said opening of said retainer ring being circular and having a diameter greater than said outside diameter.

15. The container according to claim 11, wherein said at least one node edge is two inwardly extending curved edges which intersect at a common central point between adjacent nodes.

16. A container for storing and dispensing a continuous wire from a coil of wire, the wire coil being donut-shaped and having an outwardly facing surface having an outer coil diameter, an inwardly facing surface having an inner coil diameter and top and bottom surfaces defining a coil height; said container comprising: an outer carton having a circular bottom wall and a cylindrical side wall extending upwardly from said bottom wall and having an inner surface, a plurality of supports equally spaced apart about said inner surface and extending upwardly therealong from said bottom wall, said supports engaging the outwardly facing surface of the wire coil, and a substantially planar retainer ring having an opening producing an inner edge and an outer peripheral edge including a plurality of nodes which extend radially outwardly beyond the outer surface of the wire coil, adjacent ones of said nodes being joined by an inwardly extending node edge, said retainer ring being positioned on the top surface of the wire coil, and at least one of said node edges engaging one of said supports to prevent said retainer ring from rotating relative to said side wall.

17. The container according to claim 16, wherein said nodes have arcuate radially outer edges which are concave relative to said opening.

18. The container according to claim 17, wherein said node edge is arcuate and convex relative to said opening.

19. The container according to claim 16, wherein said plurality of supports is four supports.

20. The container according to claim 19, wherein said plurality of nodes is four nodes.

21. The container according to claim 20, wherein said supports are cylindrical in cross-section transverse to said sidewall.

* * * * *